US005100077A

United States Patent [19]

Gagné et al.

[11] Patent Number: 5,100,077

[45] Date of Patent: Mar. 31, 1992

[54] UNWINDING REEL

[76] Inventors: Denis Gagné, 2683, Rang Noiseux, Dunham, Québec, Canada, J0E 1M0; Sylvio Noiseux, 156, Loiselle, Apt. 4, Cowansville, Québec, Canada, J2K 2B7

[21] Appl. No.: 698,818

[22] Filed: May 13, 1991

[51] Int. Cl.[5] ..... B65H 49/18

[52] U.S. Cl. ..... 242/129; 242/110.3

[58] Field of Search ..... 242/129, 115, 116, 105, 242/106, 103, 110, 110.3, 78.6, 78.7

[56] References Cited

U.S. PATENT DOCUMENTS

| | | | |
|---|---|---|---|
| 3,052,425 | 9/1962 | Reed et al. | 242/129 X |
| 3,162,394 | 12/1964 | Culpepper et al. | 242/105 X |
| 3,186,659 | 6/1965 | Arnold | 242/129 |
| 3,224,707 | 12/1965 | Arnold | 242/129 |
| 3,392,960 | 7/1968 | Bye | 242/129 X |
| 3,544,029 | 12/1970 | Meier | 242/78.6 |
| 3,556,431 | 1/1971 | Freitag | 242/129 |

FOREIGN PATENT DOCUMENTS

| | | | |
|---|---|---|---|
| 163137 | 5/1955 | Australia | 242/110.3 |
| 881937 | 11/1954 | Fed. Rep. of Germany | 242/105 |
| 856007 | 3/1940 | France | 242/110.3 |

*Primary Examiner*—Stanley N. Gilreath
*Attorney, Agent, or Firm*—Roland L. Morneau

[57] ABSTRACT

A reel for unwinding a coil of wire of relatively stiff material rotatably supports the coil on its outer periphery. The coil is unwound by pulling on the innermost spire through a fixed guiding channel located between the center and the periphery of the coil. The channel is perpendicular to a radius of the coil and slightly tilted relative to the plane of the coil.

6 Claims, 4 Drawing Sheets

A

UNWINDING REEL

FIELD OF THE INVENTION

This invention relates to a reel for unwinding a coil of wire and more particularly to a reel for unwinding from the innermost spire a torus-shaped coil made of wire of relatively stiff material.

BACKGROUND OF THE INVENTION

It is common practice for shipping and handling purposes to wind relatively stiff wire such as electrical cable into spires forming torus shaped coils which are later unwinded during installation of the wire.

Since the spires forming the coils are made of relatively stiff material, they are characterized by a radial outward urge to unwind. During shipping and handling, the coil is prevented from unwinding by a set of straps tied around the spires. The straps which encircle the spires are spacedly disposed around the coil along planes parallel to the radius of the coil.

Conventional structures used to house the coil during the unwinding operation include boxes having a front aperture parallel to the plane of the coil and located adjacent the longitudinal axis of the coil through which the innermost spire is pulled out.

When the coil is positioned inside the box, the straps are removed and the spires located as the outer periphery of the coil resiliently abutt against the walls of the box which restrain their radial urge to unwind.

One of the main problems encountered with this type of structure is that, since the coil does not rotate, the wire has a tendency to twist helicoidally on itself as it is being pulled. The wire being relatively stiff it has a tendency to resiliently untwist, this situation thus creates a potential hazard for the person pulling on the coil as it is being unwinded.

Various structures such as the ones described in U.S. Pat. Nos. 2,448,490; 3,673,627 and 3,662,421 have been proposed to rotatably unwind relatively stiff material such as sewer cleaner snakes. However, these structures are both relatively complex and cumbersome.

Accordingly, the present invention relates to a reel for unwinding a coil of relatively stiff material from the innermost spire. The reel restrains the outward radial urge of unwinding the coil while allowing the coil to rotate as it is being unwinded so that the wire will not helicoidally twist unto itself.

Furthermore, the reel embodying the present invention is of simple construction in order to provide an unwinding mechanism which is economical and easy to use.

SUMMARY OF THE INVENTION

The present invention relates to a reel for unwinding a torus shaped coil made of spires of relatively stiff wire adapted to be unwound from the innermost spire of the coil. The reel comprises a means for supporting the coil about its outer periphery, a means for allowing the coil to rotate about an axis substantially corresponding to the central axis of the coil and tubular means for threadally guiding the innermost spire. The innermost spire is adapted to be pulled through the tubular means.

This tubular means is located adjacent the plane of the coil between the periphery and the central axis of the coil. The rigidity of the innermost spire has a tendency to straighten the spire from its wounded curvature and thus to create a lever action in the tubular means which prevents the retraction of the spire from the tubular means.

The supporting means comprises radial arms which extend from the central axis of the coil. Each arm has a U-shaped member encircling a portion of the periphery of the coil. At least one of the radial arms is lengthly adjustable which allows the coil to be fittingly gripped by the U-shaped members.

The means for allowing the coil to rotate comprises an axle which is located at the intersection of the arms and the central axis.

The tubular means comprises a tubular channel which has a diameter slightly larger than the diameter of the wire. The channel is generally oriented at right angle relative to the radius of the coil, so that when the innermost spire is inside the channel, it has a tendency to frictionally abut against the channel in a direction away from the central axis.

The tubular channel is preferably provided with a tightening screw adapted to penetrate in the channel for locking the spire inside the channel and providing additional security when the reel is not in operation. The tubular channel is mounted on an independent arm angularly fixed relative to the axle and has a longitudinal axis disposed at a slight angle relative to the plane of the coil. In a particular embodiment of the invention, a loop member is axially aligned with and in front of the tubular channel.

A circular shield extends in a plane located in front of the coil. The shield is provided with an aperture for allowing the passage of the innermost spire.

DETAILED DESCRIPTION OF THE INVENTION

Figures 1, 2:
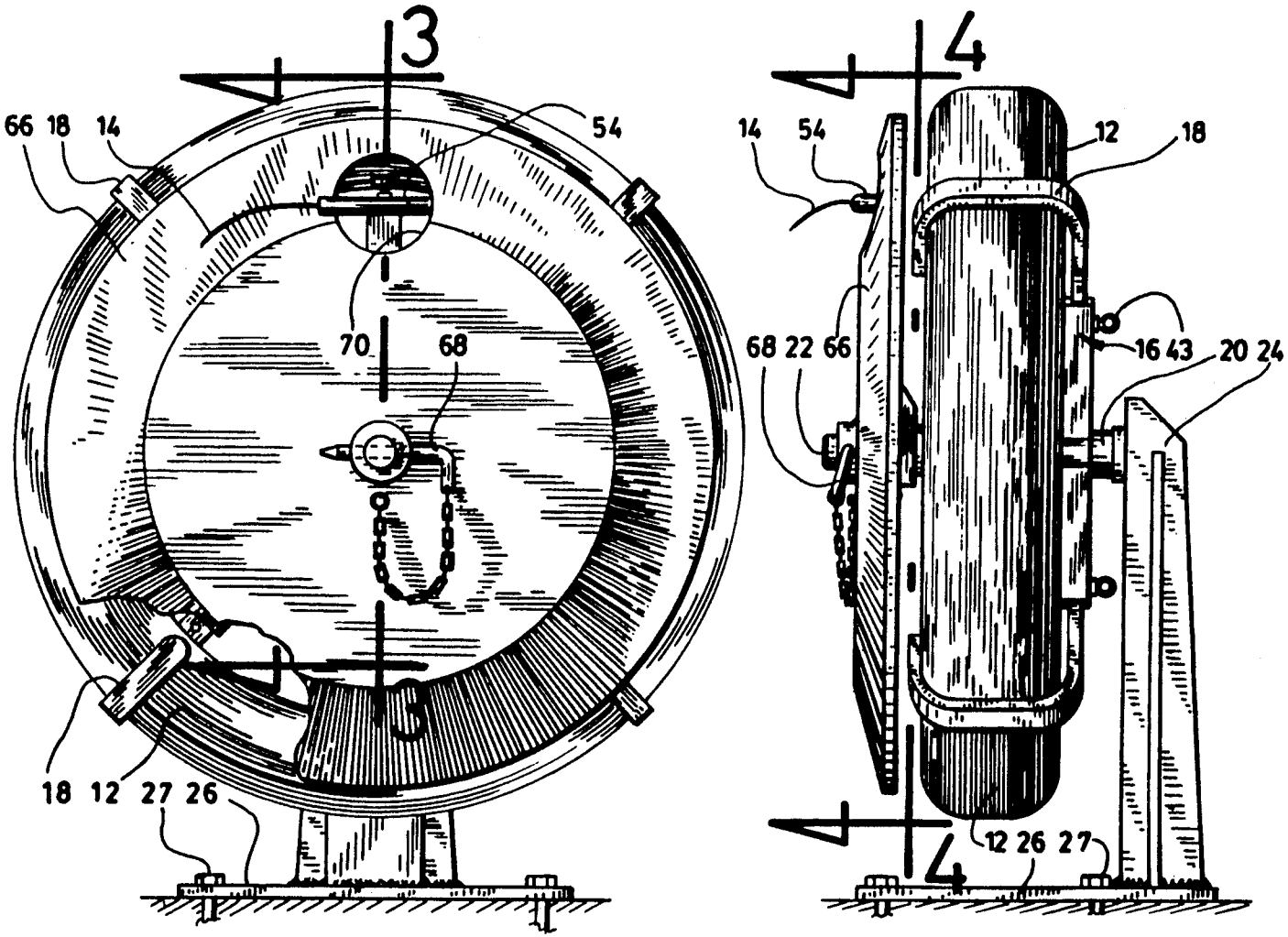
FIG. 1 is a front view of the reel according to the invention.
FIG. 2 is a side view of the reel.

Referring to the figures, there is shown a reel 10 for unwinding a torus shaped coil 12 made of spires of a relatively stiff wire. The coil 12 is adapted to the unwound from an innermost spire 14.

The reel 10 has a set of radial arms 16 supporting the coil 12 about its outer periphery. Each arm 16 has a U-shaped section 18 encircling a portion of the periphery of the coil 12.

The arms 16 extend from a hub 20 rotatably mounted on an axle 22. A set of reinforcing ribs 23 are welded to the hub 20 at one of their ends and to the arms 16 at their other end. The axle 22 is rigidly fixed by welding lines W to a supporting post 24 welded to a base plate 26. The base plate 26 is anchored to the ground by anchoring bolts 27.

In order to fittingly accomodate coils of various diameters, at least one and preferably two of the radial arms 16 are adjustable in length.

Figures 5, 7, 7A, 8:
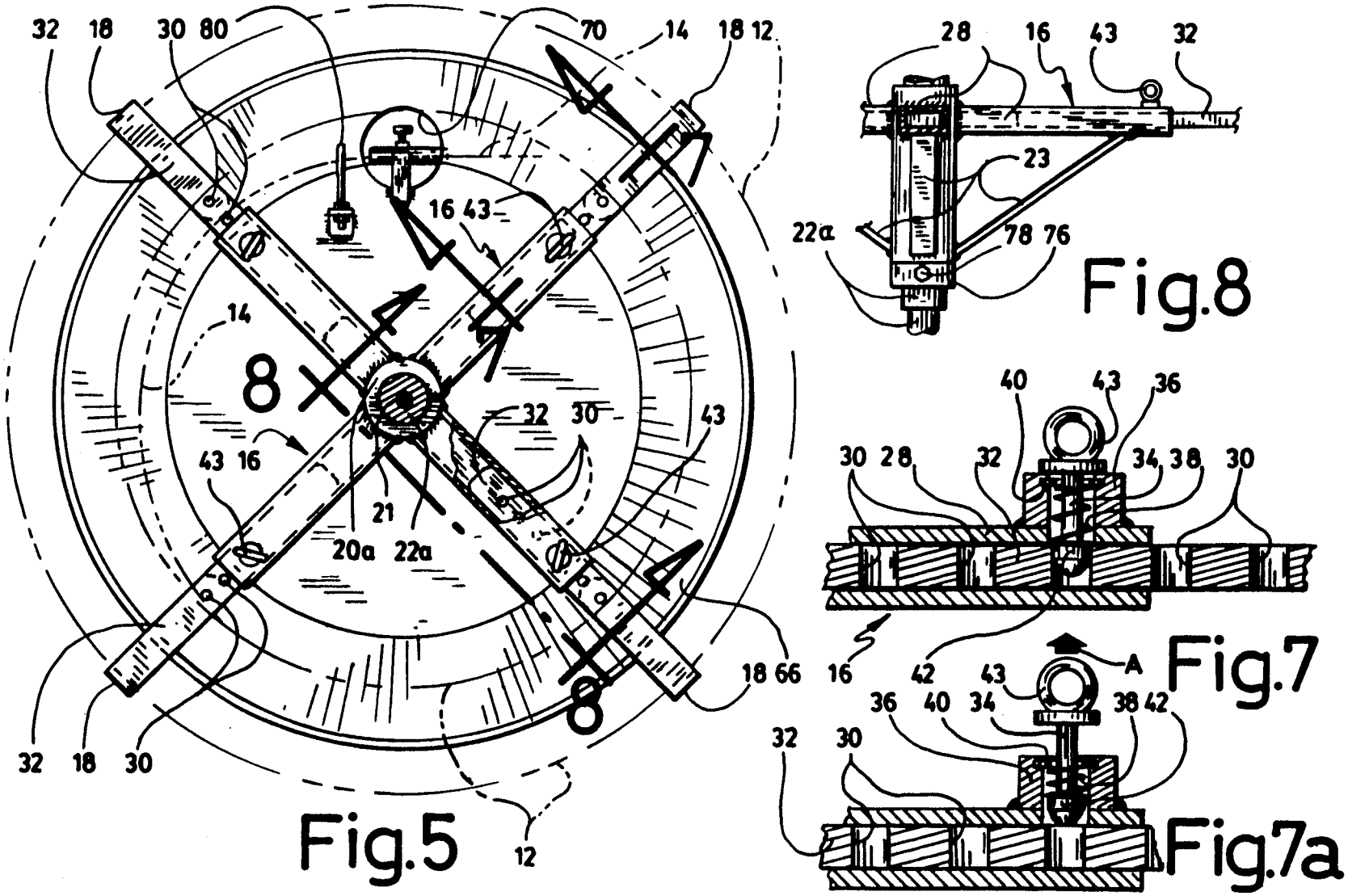
FIG. 5 is a cross-sectional view taken along line 5—5 of FIG. 3*a*.
FIG. 7 is a cross-sectional view taken along line 7—7 of FIG. 5.
FIG. 7*a* is a view similar to FIG. 7 illustrating the pin in a retracted position.
FIG. 8 is a cross-sectional view taken along line 8—8 of FIG. 5.

In the embodiment more specifically illustrated in FIGS. 5, 7 and 8, the four arms 16 have a tubular hollow section 28 adapted to telescopically receive the U-shaped section 18.

A set of aligned locking apertures 30 extend through a stem portion 32 of the U-shaped section 18. The apertures 30 are used in conjuction with a plunger having a locking pin 34 for stopping the telescopic arms 16 at a given length.

The pin 34 extends through a spacing guide 36 welded to the tubular section 28. A spring 38 is used to bias the pin 34 into one of the locking apertures 30. The spring 38 abuts at one end against an abutting washer 40 and at the other end against a protuberant head section 42 of the pin 34. As illustrated in FIG. *7a*, the pin 34 can be retracted from the aperture 30 by a pulling action in the direction of arrow A on a gripping ring 43 formed integral with the pin 34.

Figure 3A:
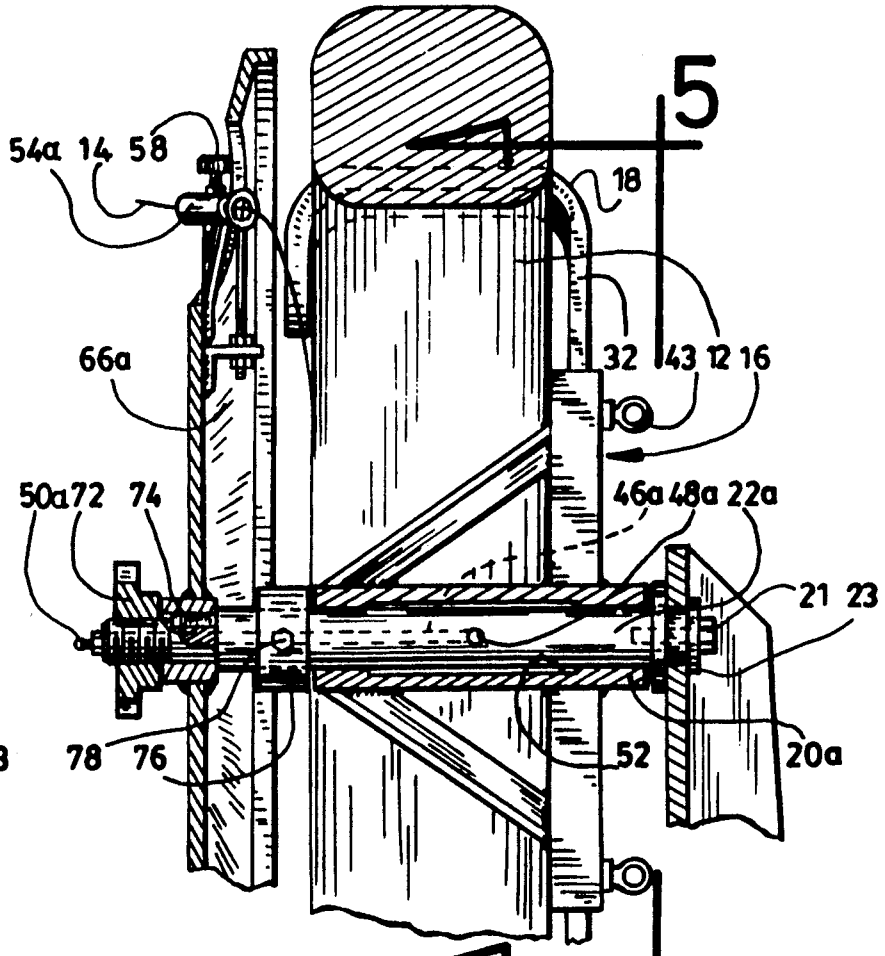
FIG. 3*a* is a cross-sectional view similar to FIG. 3 illustrating a second embodiment of the invention.
Figure 3:
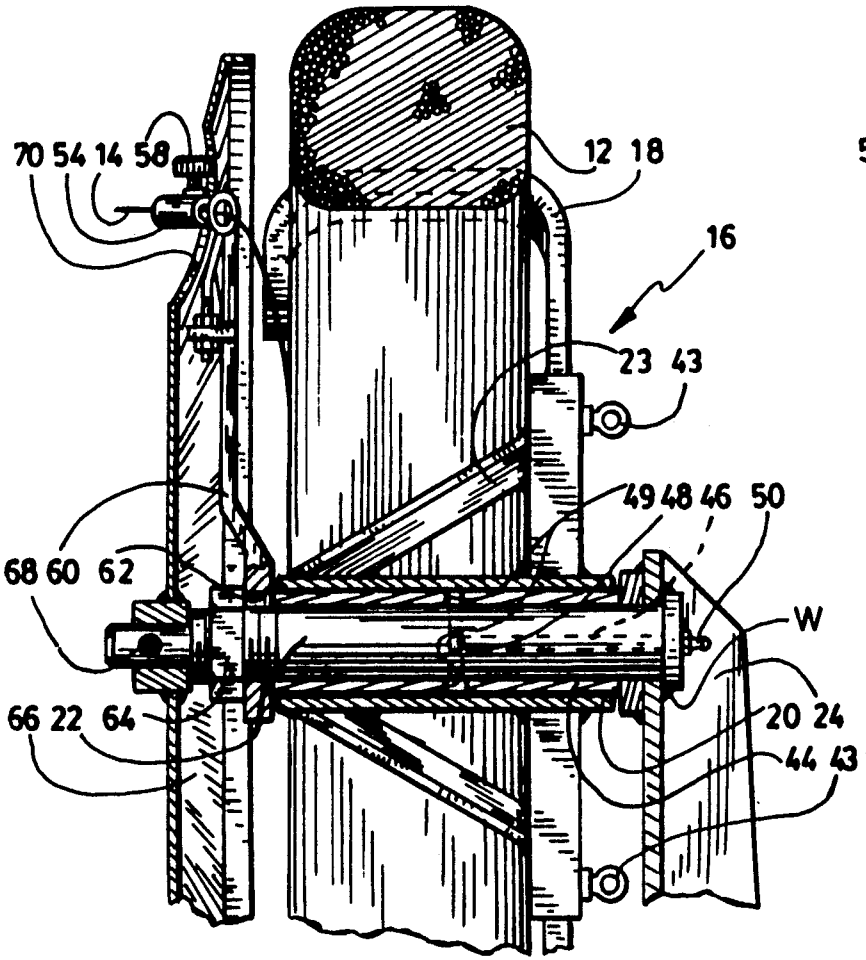
FIG. 3 is a cross-sectional view taken along line 3—3 of FIG. 1.
Figure 4A:
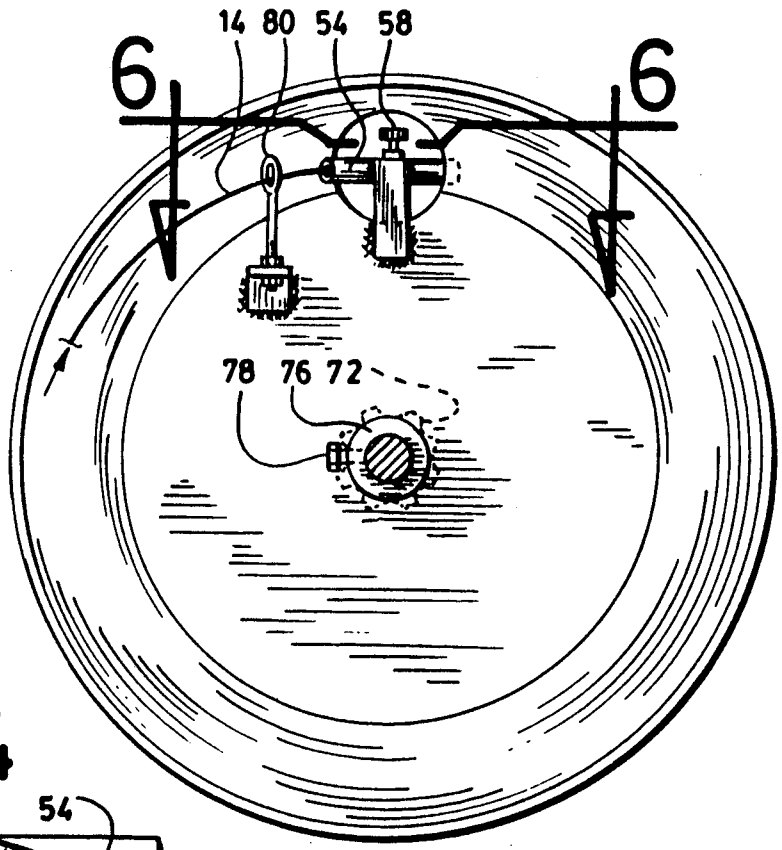
FIG. 4*a* is a cross-sectional view similar to FIG. 4 of the second embodiment shown in FIG. 3*a*.
Figure 4:
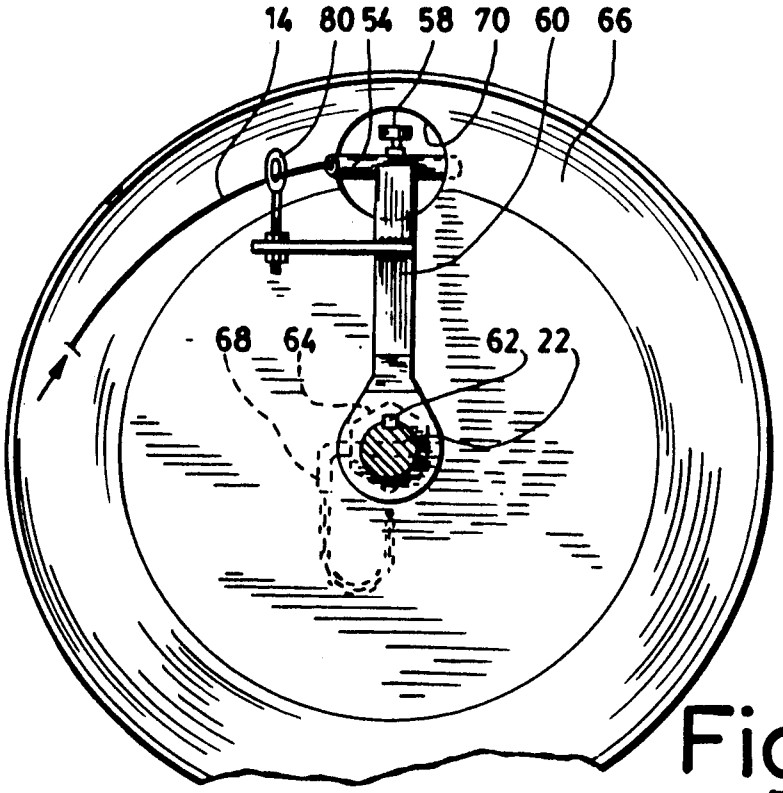
FIG. 4 is a cross-sectional view taken along line 4—4 of FIG. 2.
Figure 6:
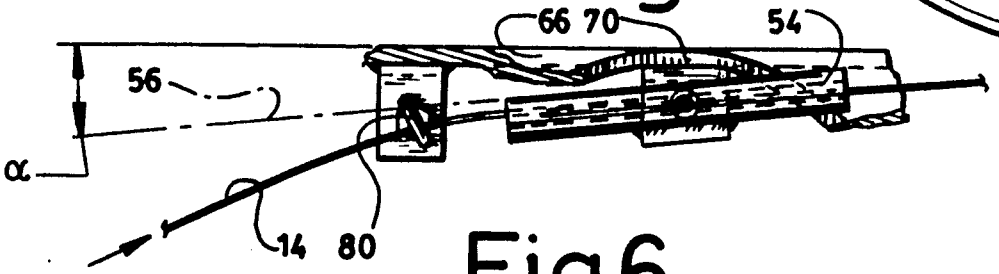
FIG. 6 is a detail top view of a tubular guide member of the invention taken along line 6—6 of FIG. 4*a*.

In one embodiment of the invention illustrated in FIG. 3, a sleeve 44 is mounted between the hub 20 and the axle 22 to reduce friction. A longitudinal lubricating channel 46 extends through the axle 22 from the rear end portion of the axle 22 to a set of radial lubricating channels 48 provided in the axle 22. The channels 48 lead to a set of corresponding lubricating apertures 49 provided in the sleeve 34. A lubricating nozzle 50 seals off the opening of the channel 46. An adequate lubricating compound such as grease can thus be injected into the channel 46 to further reduce friction between the hub 20, the axle 22 and the sleeve 44 during rotation of the hub 20.

In another embodiment of the invention illustrated in FIG. *3a*, the lubricating channel 46*a* extends from a front lubricating nozzle 50*a* of the axle 22*a* to the radial lubricating apertures 48*a*.

The hub 20*a* is provided with an internal cylindrical longitudinal recess 52 adapted to receive the lubricant injected through the lubricating channel 46*a*.

In this particular embodiment of the invention, the axle 22*a* is rigidly attached to the supporting post 24 by a screw 23 extending through a flat washer 21.

One of the main features of the present invention resides in the use of a tubular guide 54 located adjacent the plane of the coil 12, between the periphery of the coil 12 and the hub 20. A longitudinal axis 56 of the tubular guide 54 is generally oriented at right angle relative to the radius of the coil 12 and at a slight angle alpha relative to the plane of a circular shield 66 mounted parallel to the coil 12.

The tubular guide 54 is adapted to serve both as guiding means and as a braking means for preventing the retraction of spire 14. During the unwinding operation, it acts as a guiding means since the innermost spire 14 is threadedly pulled through the guide 54. When the innermost spire 14 is not being pulled, the tubular guide 54 acts as a braking means. Since the innermost spire 14 is made of relatively stiff material, it has a tendency to straighten from its wound curvature thus frictionally abutting against the tubular guide 54 in a direction away from the central axis. The innermost spire 14 therefore creates a lever action in the tubular guide 54 which prevents its retraction.

The tubular guide 54 is provided with a tightening screw 58 adapted to penetrate in the guide 54 and positively lock the innermost spire 14 in its protracted position as shown in FIGS. 1–6.

In the embodiment illustrated in FIG. 3, the tubular guide 54 is mounted on a guiding arm 60. The guiding arm 60 is mounted on the axle 22 and prevented from rotating by key bolt 62.

A locking nut 64 squeezes the guiding arm 60 against the sleeve 44.

A disk-shaped shield 66 is mounted on the front end of the axle 22. A retractable locking pin 68 radially inserted in the axle 22 prevents longitudinal retraction of the shield 66 from the axle 22. An aperture 70 in the shield 66, located adjacent the guiding arm 60, allows for passage of the innermost spire 14 through the shield 66.

In the embodiment illustrated in FIG. *3a*, the tubular guide 54*a* is welded to the shield 66*a*. The shield 66*a* is prevented from retraction by an axle nut 72 and prevented from rotating by a shield key bolt 74.

The hub 20*a* is prevented from longitudinal retraction by a collar 76 mounted on the axle 22*a* and locked by a bolt 78.

A loop 80 is axially aligned with and in front of the tubular guide 54.

The loop 80 is adapted to threadedly receive the innermost spire 14 from the tubular guide 54 and act as an abutting means creating a greater lever action. The addition of the loop 80 is preferable to the use of a longer tubular guide 54 because it can be more easily replaced when subject to wear caused by friction with the wire. In the embodiment illustrated in FIG. 3, the loop 80 is mounted on the guiding arm 60 while in the embodiment illustrated in FIG. *3a* the loop 80 is welded on the shield 66.

In an alternative embodiment of the invention, more than one loop is used. The additional loops are disposed along the periphery in front of the shield 66 allowing for an even greater guiding and braking action.

We claim:

1. A reel for unwinding a torus-shaped coil made of spires of relatively stiff wire adapted to be unwound from the innermost spire of the coil, said reel comprising an angularly fixed horizontal axle adapted to be secured at one end to a fixed support, a hub rotatably mounted over said axle, a plurality of arms radially extending from said hub, means for varying the length of said arms, a U-shaped member extending from each of said arms, said U-shaped members adapted to encircle a portion of the periphery of the coil and to support said coil, said U-shaped members having two ends, one of said ends extending from said arms for facing one side of the coil, a rigid tubular member secured to said axle in a plane adjacent and substantially parallel to the coil between the periphery of the coil and said axle, said tubular member having a diameter slightly larger than the diameter of the said wire, said tubular member being generally oriented at about a right angle relative to a radius of said coil and with a slight angle relative to the plane of the coil for frictionally braking said wire when released, said tubular member adapted to threadedly guide the innermost spire, a circular shield plate centrally fixed to said axle and located for facing the other ends of the U-shaped members, the perimeter of said plate overlapping said other ends, said plate being provided with an aperture substantially facing said tubular member, said innermost spire adapted to be pulled through said tubular member and said aperture, whereby said tubular member is adapted to guide said innermost wire when the latter is pulled therethrough, and to prevent its retraction when the wire is released.

2. A reel as recited in claim 1, wherein said tubular member is provided with a tightening screw adapted to penetrate in the tubular member for locking said spire in said member.

3. A reel as recited in claim 1, wherein said tubular member is fixed on said plate and extends through said aperture.

4. A reel as recited in claim 1, comprising a loop member axially aligned with and in front of said tubular member.

5. A reel as recited in claim 1, wherein said U-shaped members are releasably mounted on said arm.

6. A reel as recited in claim 1, comprising a supporting post and a base plate for supporting said post, said axle being secured at one end adjacent said arms to said post.

* * * * *